US006698469B2

(12) United States Patent
Sakamoto et al.

(10) Patent No.: US 6,698,469 B2
(45) Date of Patent: Mar. 2, 2004

(54) CYLINDER CABINET AND METHOD OF PURGING REMAINING GAS IN THE PIPE THEREOF

(75) Inventors: Yutaka Sakamoto, Tokyo (JP); Tsuneo Kano, Tokyo (JP); Takashi Ogawa, Tokyo (JP); Hiroshi Matsumura, Tokyo (JP); Toshiaki Sango, Tokyo (JP); Kiyoto Itoh, Tokyo (JP); Norio Otake, Kanagawa (JP)

(73) Assignees: NEC Electronics Corporation, Kanagawa (JP); Toyoku Kagaku Co., Ltd., Kanagawa (JP)

( * ) Notice: Subject to any disclaimer, the term of this patent is extended or adjusted under 35 U.S.C. 154(b) by 0 days.

(21) Appl. No.: 10/180,497

(22) Filed: Jun. 27, 2002

(65) Prior Publication Data

US 2003/0010395 A1 Jan. 16, 2003

(30) Foreign Application Priority Data

Jun. 27, 2001 (JP) ..... 2001-194662

(51) Int. Cl.[7] ..... F17C 13/00

(52) U.S. Cl. ..... 141/91; 141/4; 141/8; 141/18; 141/63; 141/65; 141/93

(58) Field of Search ..... 141/1, 4, 8, 18, 141/63, 65, 89–91, 93; 222/3

(56) References Cited

U.S. PATENT DOCUMENTS

| | | | | | |
|---|---|---|---|---|---|
| 4,989,160 | A | * | 1/1991 | Garrett et al. | 700/282 |
| 5,137,047 | A | * | 8/1992 | George | 137/240 |
| 5,330,072 | A | * | 7/1994 | Ferri, Jr. et al. | 222/1 |
| 5,417,236 | A | * | 5/1995 | Moore et al. | 137/15.16 |
| 5,551,309 | A | * | 9/1996 | Goossens et al. | 73/863 |
| 5,607,002 | A | * | 3/1997 | Siegele et al. | 141/198 |
| 6,343,627 | B1 | * | 2/2002 | Hasaka et al. | 141/18 |
| 6,435,229 | B1 | * | 8/2002 | Noah et al. | 141/231 |

* cited by examiner

*Primary Examiner*—J. Casimer Jacyna
(74) *Attorney, Agent, or Firm*—Young & Thompson

(57) ABSTRACT

A cylinder containing gas has a valve and is connected to a delivery side through a filling pipe, a primary pipe, a first air-operated valve, a pressure reducing valve, a secondary pipe, and a second air-operated valve. Inert gas flows into the primary pipe through an air-operated valve. The primary pipe is connected to a vacuum generator through an air-operated valve and a pipe. Gas remaining in the primary pipe is purged as exhaust gas by automatically repeating leaving-pipe-in-pressurized-state purge for pressurizing the inside of the primary pipe by the inert gas and leaving the pipe in this state for 2 to 10 minutes and evacuating the pipe for 20 seconds. Gas remaining in the primary pipe is purged with high-efficiency, and the vacuum generator is stopped while the inside of the primary pipe is pressurized in the leaving-pipe-in-pressurized-state purge and the just-before-replacement purge.

4 Claims, 5 Drawing Sheets

CYLINDER CABINET AND METHOD OF PURGING REMAINING GAS IN THE PIPE THEREOF

BACKGROUND OF THE INVENTION

1. Field of the Invention

The present invention relates to an apparatus for and a method of purging remaining gas in the pipe of a cylinder cabinet.

2. Description of the Related Art

A conventional cylinder cabinet will be described making use of FIG. 1 because it is the same as that according to a first embodiment of the present invention.

Conventionally, a method of purging gas remaining in a primary pipe 14 of a cylinder cabinet is mainly executed manually. That is, leaving-pipe-in-pressurized-state purge is repeated manually to pressurize the inside of the primary pipe 14 by inert gas 15 and to leave it in the pressurized state for 5 to 30 seconds and to evacuate the primary pipe 14 by a vacuum generator 11 for about 20 seconds. Further, when gas 22 in a cylinder 1 is exhausted on the delivery side 16, it is replaced with a new cylinder filled with gas. At the time, the inside of the primary pipe 14 is pressurized by the inert gas 15 for at least 10 seconds and then evacuated for about 20 seconds once manually just before a filling pipe 2 is removed from the cylinder 1.

This conventional method of purging remaining gas in the primary pipe 14 cannot sufficiently accomplish an intended end. That is, when the cylinder 1 is replaced, the inside of the pipe is corroded by the reaction of water in the atmosphere with the remaining gas. As a result, troubles are caused in parts such as respective air-operated valves and a pressure reducing valve. Further, actually, the filling pipe 2 is removed from the cylinder 1 in the state that gas is left and liberated in the primary pipe 14 for a long time because the cylinder 1 cannot be replaced just after the completion of purge of the remaining gas in the primary pipe 14, thereby leakage of gas is caused. Furthermore, the vacuum generator 11 is operated at all times while the inside of the primary pipe 14 is pressurized in the leaving-pipe-in-pressurized-state purge and the just-before-replacement purge, which increases the consumption of the nitrogen gas 17 for start.

SUMMARY OF THE INVENTION

Accordingly, an object of the present invention is to provide a cylinder cabinet capable of purging remaining gas in a primary pipe with high-efficiency and stopping a vacuum generator while the inside of the primary pipe is pressurized in leaving-pipe-in-pressurized-state purge and just-before-replacement purge and to provide a method of purging the remaining gas in the primary pipe.

According to the present invention, there is provided a cylinder cabinet comprising a cylinder containing gas and having a valve, a filling pipe, a primary pipe, a first air-operated valve, a pressure reducing valve, a secondary pipe, and a second air-operated valve through which the cylinder is connected to a supply side, a third air-operated valve through which inert gas flows into the primary pipe, and a vacuum generator to which the primary pipe is connected through a fourth air-operated valve and a pipe, wherein remaining gas in the primary pipe is purged by automatically repeating leaving-pipe-in-pressurized-state purge for pressurizing the inside of the primary pipe by the inert gas and leaving the pipe in the pressurized state for 2 to 10 minutes and evacuating the pipe for 20 seconds.

Further, according to the present invention, there is provided a method of purging remaining gas in a pipe in a cylinder cabinet comprising a cylinder cabinet containing gas and having a valve, a filling pipe, a primary pipe, a first air-operated valve, a pressure reducing valve, a secondary pipe, and a second air-operated valve through which the cylinder is connected to a supply side, a third air-operated valve through which inert gas flows into the primary pipe, and a vacuum generator to which the primary pipe is connected through a fourth air-operated valve and a pipe, the method comprising the step of purging remaining gas in the primary pipe by automatically executing leaving-pipe-in-pressurized-state purge for repeatedly pressurizing the inside of the primary pipe by the inert gas and leaving the pipe in the pressurized state for 2 to 10 minutes and evacuating the pipe for 20 seconds.

DESCRIPTION OF THE PREFERRED EMBODIMENTS

Two embodiments of the present invention will be described.

Figure 2:
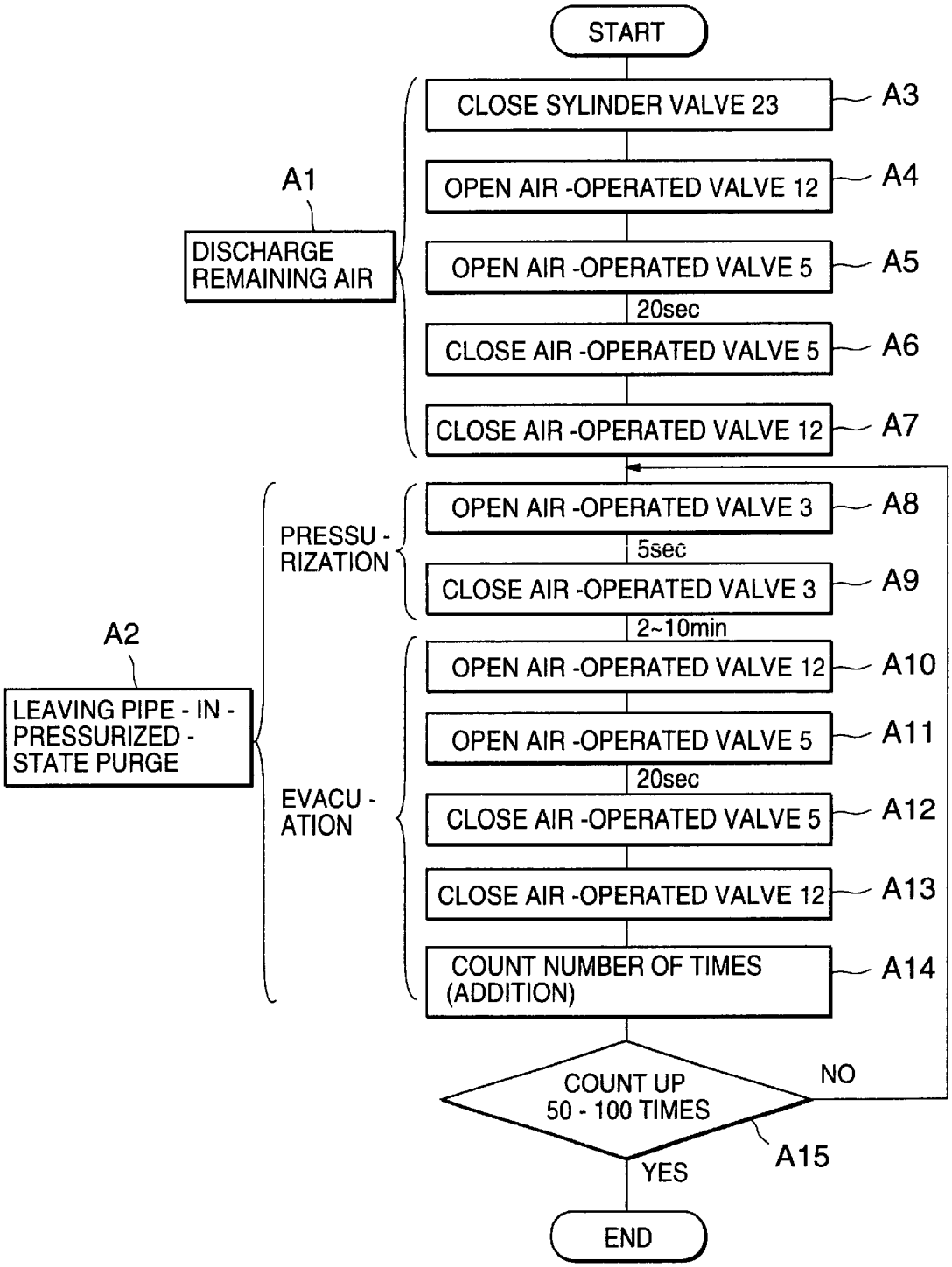
FIG. 2 is a flowchart for exhausting remaining gas and executing leaving-pipe-in-pressurized-state purge according to the first embodiment of the present invention.
Figure 3:
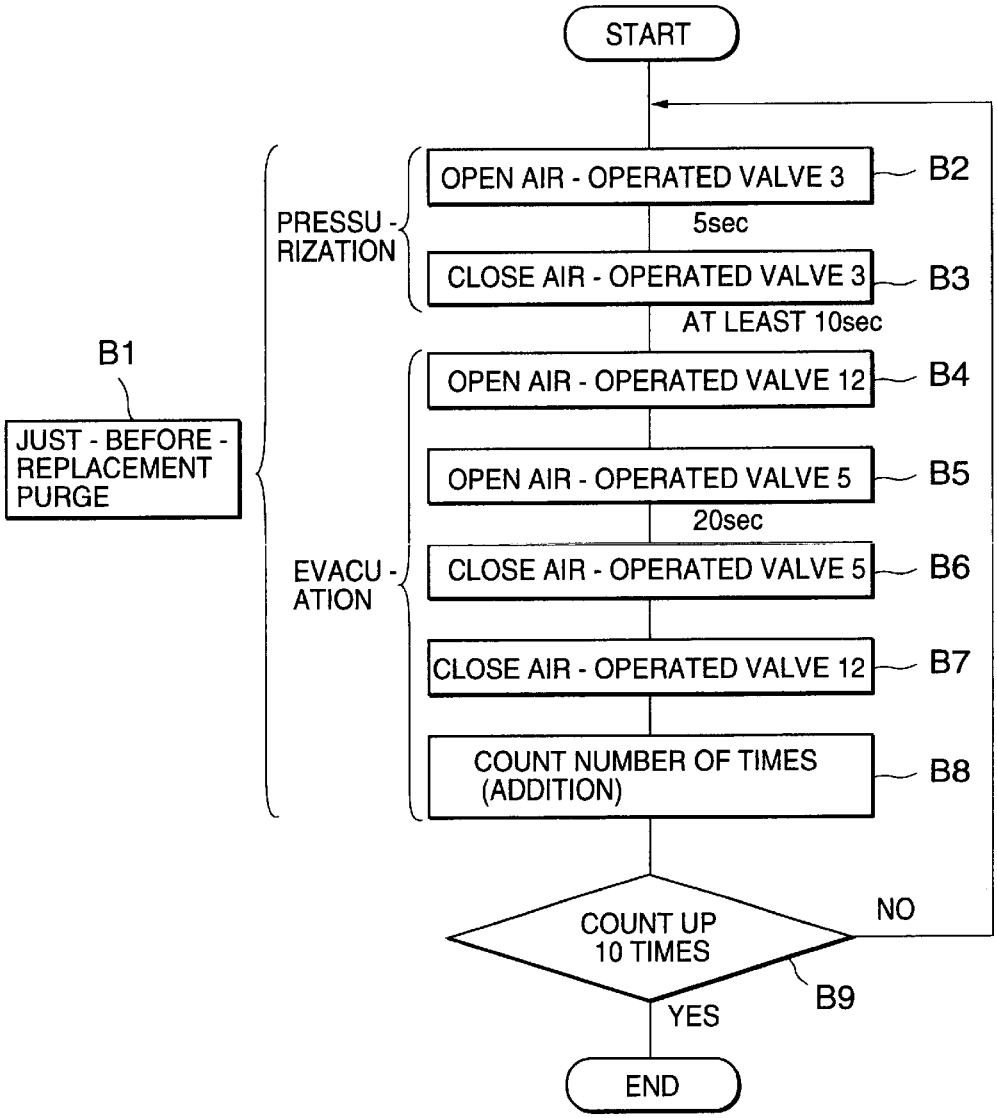
FIG. 3 is a flowchart for executing just-before-replacement purge according to the first embodiment of the present invention.

First, a first embodiment of the present invention will be described with reference to FIGS. 1 to 3.

Figure 1:
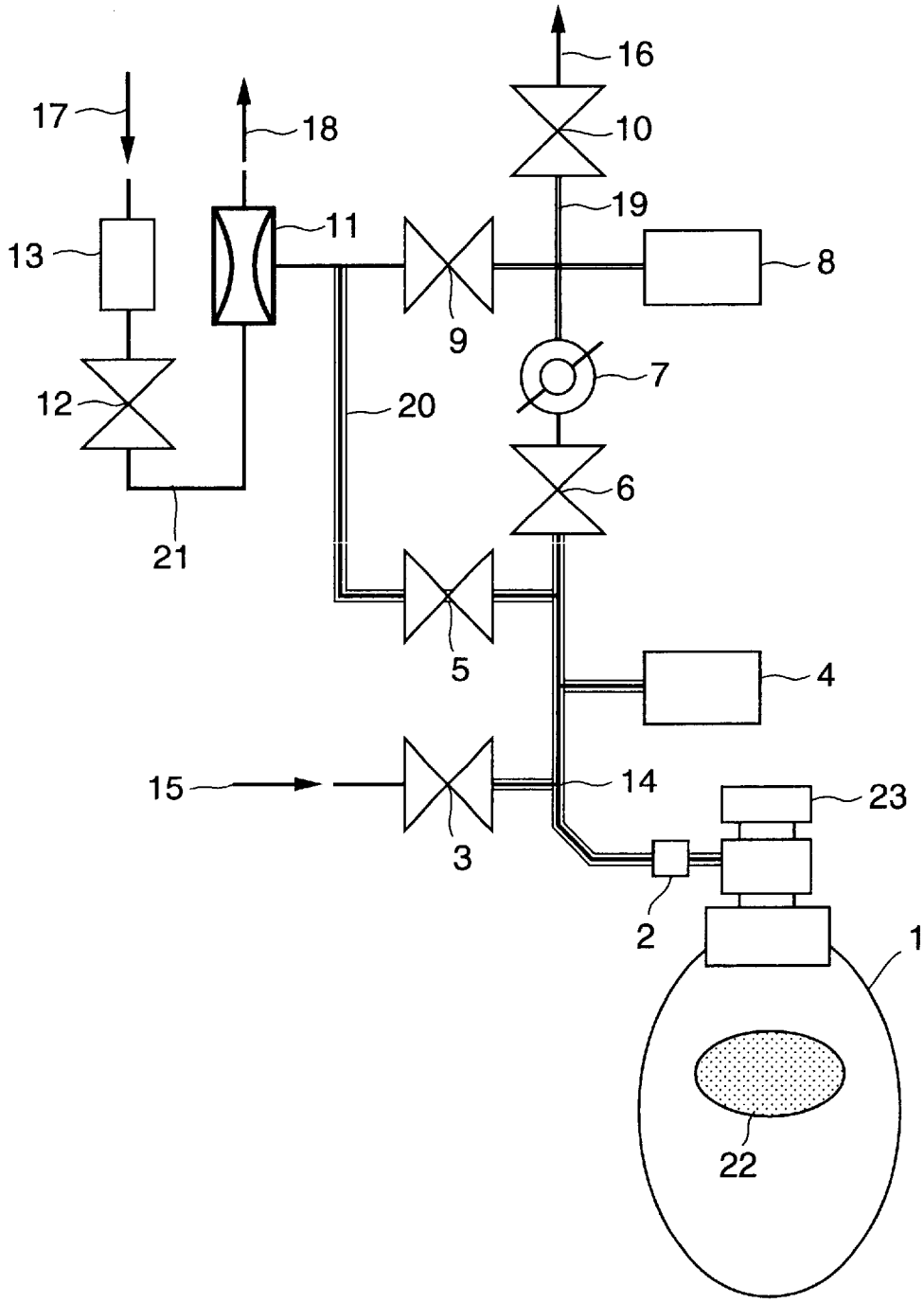
FIG. 1 is a schematic view of a cylinder cabinet according to a first embodiment of the present invention.

In FIG. 1, a cylinder 1 is connected to a filling pipe 2. When a cylinder valve 23 is opened, gas 22 in the cylinder 1 is introduced into a primary pipe 14. When an air-operated valve 6 is opened, the pressure of the gas 22 is reduced by a pressure reducing valve 7, and an air-operated valve 10 is opened, the gas 22 is supplied to a delivery side 16 through a secondary pipe 19. A pressure gauge 4 can detect the pressure in the primary pipe 14, whereas a pressure gauge 8 can detect the pressure in the secondary pipe 19. When an air-operated valve 3 is opened, inert gas 15 such as nitrogen gas is introduced into the primary pipe 14. When an air-operated valve 12 is opened, nitrogen gas 17 flows into a vacuum generator 11 through a pipe 21, thereby the inside of a pipe 20 can be evacuated.

When an air-operated valve 9 is opened in this state, the inside of the secondary pipe 19 can be evacuated. Further, when an air-operated valve 5 is opened, the inside of the primary pipe 14 can be evacuated. The quantity of flow of the nitrogen gas 17 flowing to the vacuum generator 11 is detected by a mass flow meter 13 in terms of weight. Exhaust gas 18 exhausted from the vacuum generator 11 contains the nitrogen gas 17 and gas 22.

When the gas 22 in the cylinder 1 is exhausted by being consumed on the delivery side 16, the cylinder 1 must be replaced with a new cylinder filled with the gas 22. Unless the gas in the primary pipe 14 is removed when the cylinder 1 is replaced with the new cylinder, it leaks into the atmosphere because the filling pipe 2 is removed from the cylinder 1. Operation for purging the gas 22 in the primary pipe 14 with high-efficiency will be described with reference to FIGS. 1 to 3.

1. Exhaust of Remaining Gas (Step A1)

First, when the cylinder valve 23 is closed, the gas 22 in the cylinder 1 is not exhausted (step A3). At this time, the air-operated valves 3, 5, and 6 are closed. When the air-operated valve 12 is opened and the vacuum generator 11 is started, and then the air-operated valve 5 is opened for about 20 seconds, the gas 22 remaining in the primary pipe 14 is exhausted (steps A4 and A5). Thereafter, the air-operated valve 5 is closed and further the air-operated valve 12 is closed, thereby the vacuum generator 11 is stopped (steps A6 and A7). Thereafter, leaving-pipe-in-pressurized-state purge will be executed (step A2).

The leaving-pipe-in-pressurized-state purge will be described below.

2. Leaving-pipe-in-pressurized-state Purge (Step A2)

When the air-operated valve 3 is opened for five seconds, the inert gas 15 such as nitrogen gas of at least 0.2 MPa pressurizes the inside of the primary pipe 14 closed by the air-operated valves 5 and 6 and the cylinder valve 23 (step A8). After the completion of pressurization, the air-operated valve 3 is closed, and the primary pipe 14 is left in the pressurized-state for 2 to 10 minutes (step A9). After the primary pipe 14 has been left for 2 to 10 minutes, the air-operated valve 12 is opened and the vacuum generator 11 is started, and then the air-operated valve 5 is opened, thereby the inert gas 15 such as nitrogen gas pressurized in the primary pipe 14 is exhausted, and then the primary pipe 14 is evacuated for 20 seconds (steps A10 and A11).

After the pressurized inert gas 15 such as nitrogen gas has been exhausted from the primary pipe 14 for about 20 seconds and the primary pipe 14 has been evacuated, the air-operated valves 5 and 12 are sequentially closed, thereby the vacuum generator 11 is stopped (steps A12 and A13). The series of operation is the leaving-pipe-in-pressurized-state purge executed at a time, and the leaving-pipe-in-pressurized state purge is executed 50 to 100 times (steps A14 and A15). It was confirmed in an experiment executed using hydrogen bromide gas as the gas 22 that the remaining concentration (ppm) of the hydrogen bromide gas in this embodiment was one-several to one-several tenth that of a conventional technology. Thereafter, just-before-replacement purge is executed (step B1). The just-before-replacement purge will be described below.

3. Just-before-replacement Purge (Step B1)

When the cylinder 1 is replaced with the new cylinder, the air-operated valve 3 is opened for five seconds, and the primary pipe 14, which is closed by the air-operated valves 5 and 6 and the cylinder valve 23, is filled with the inert gas 15 such as nitrogen gas of at least 0.2 MPa (step B2) to remove the filling pipe 2 from the cylinder 1. After the completion of filling, the air-operated valve 3 is closed, and the primary pipe 14 is for at least to 10 seconds (step B3). After the primary pipe 14 has been left for at least 10 seconds, the vacuum generator 11 is started by opening the air-operated valve 12, and then the air-operated valve 5 is opened, thereby the inert gas 15 such as nitrogen gas filled in the primary pipe 14 is exhausted and the primary pipe 14 is evacuated (steps B4 and B5). After the pressurized inert gas 15 such as nitrogen gas has been exhausted from the primary pipe 14 for about 20 seconds and the primary pipe 14 has been evacuated, the air-operated valves 5 and 12 are sequentially closed, thereby the vacuum generator 11 is stopped (steps B6 and B7). The series of operation is the just-before-replacement purge executed at a time, and the just-before-replacement purge is executed about 10 times (step B8 and B9). It was confirmed in the experiment executed using the hydrogen bromide gas as the gas 22 that the concentration (ppm) of the hydrogen bromide gas was 0.3 ppm while it was 2 ppm after the leaving-pipe-in-pressurized-state purge and 27 ppm in 30 minutes after the leaving-pipe-in-pressurized-state purge.

The respective operations described above for exhausting the remaining gas and executing the leaving-pipe-in-pressurized-state purge and the just-before-replacement purge are automatically carried out by sequence control.

Figure 4:
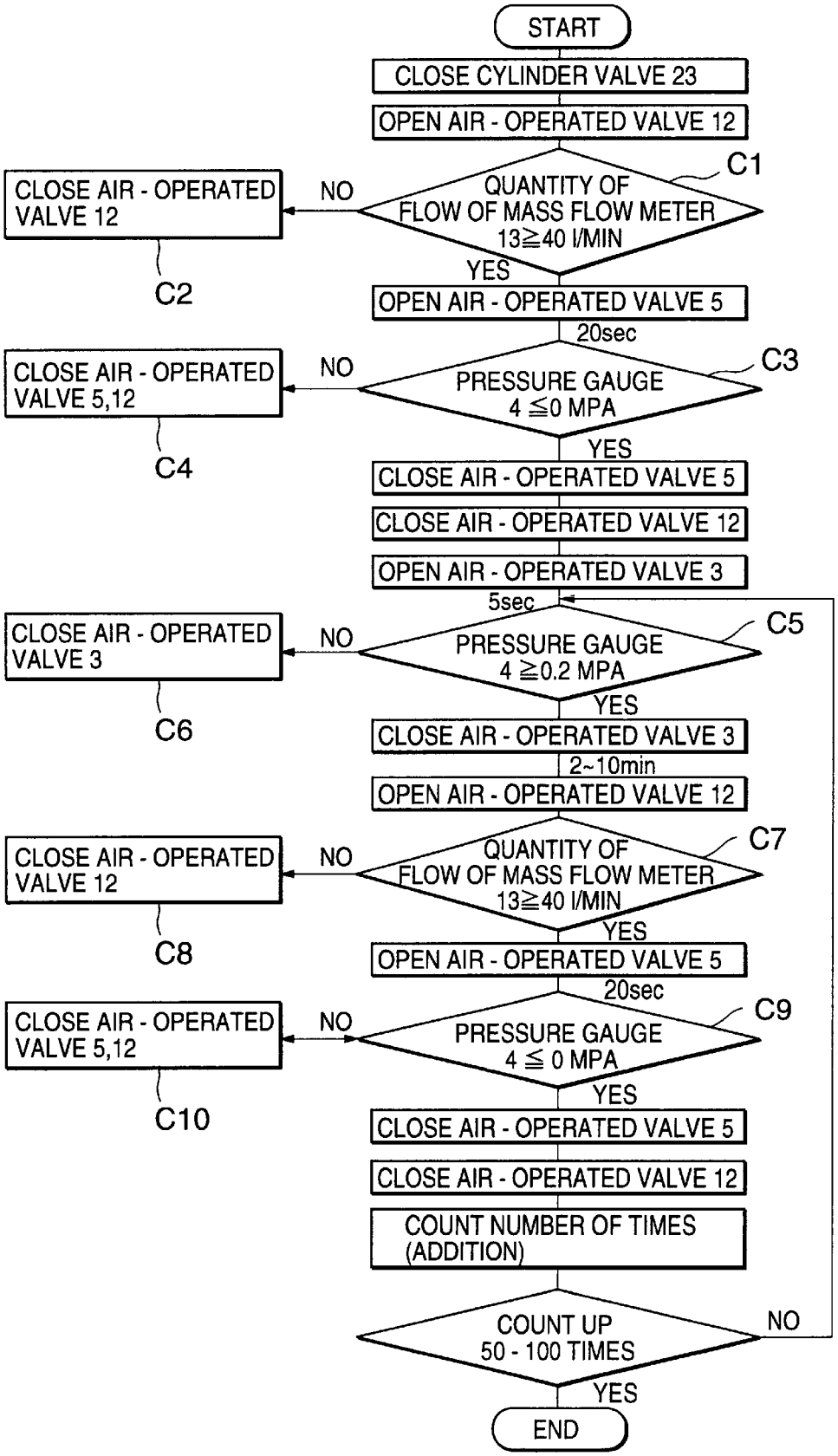
FIG. 4 is a flowchart for exhausting remaining gas and executing leaving-pipe-in-pressurized-state purge according to a second embodiment of the present invention.
Figure 5:
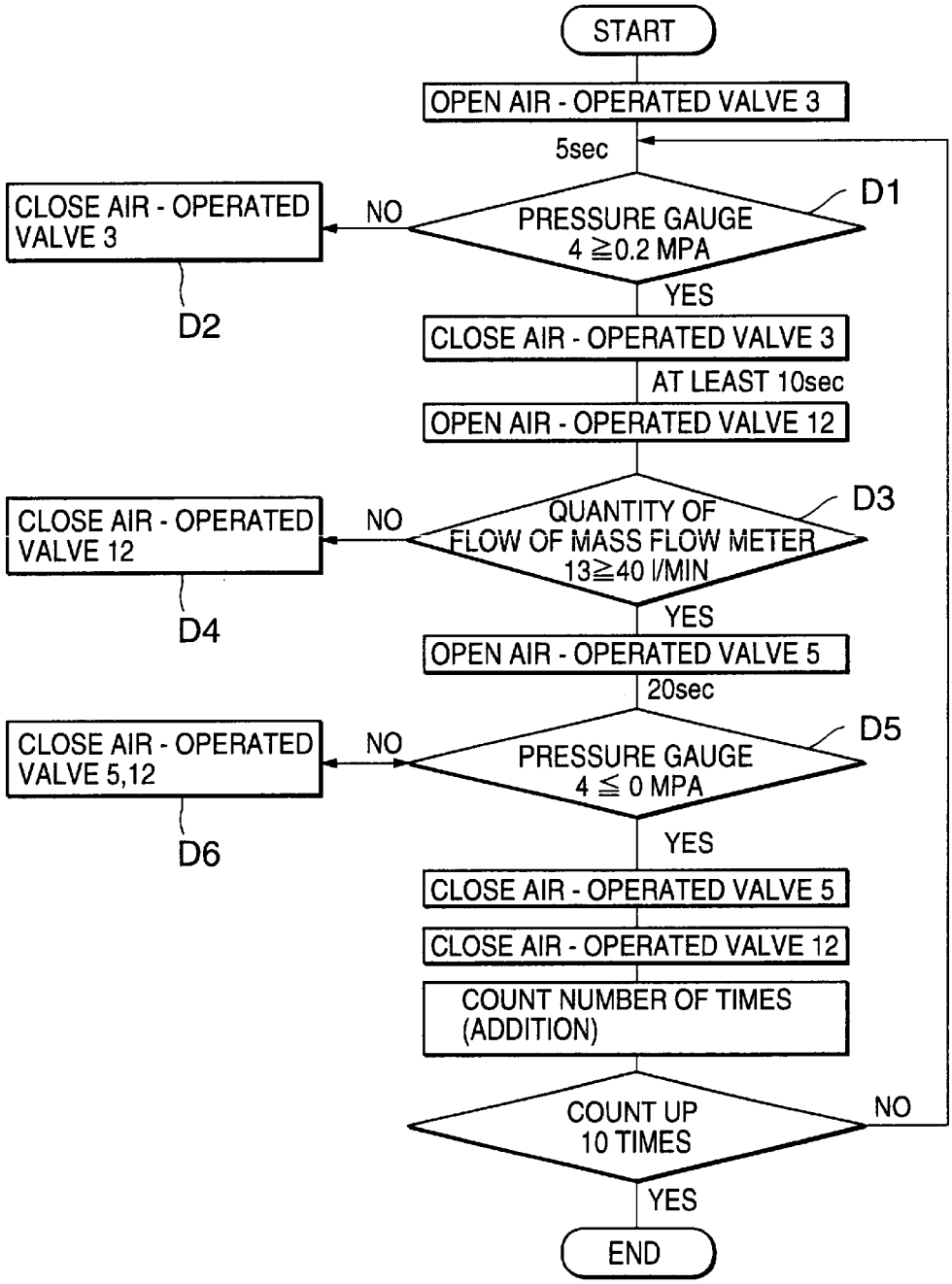
FIG. 5 is a flowchart for executing just-before-replacement purge according to the second embodiment of the present invention.

Next, a second embodiment of the present invention will be described with reference to FIGS. 1, 4, and 5. The second embodiment will be described only as to points different from those of the first embodiment, omitting the description of the points similar to those of the first embodiment.

A first different point is as described below. That is, when the air-operated valve 12 is opened, the nitrogen gas 17 flows into the vacuum generator 11 to thereby start the vacuum generator 11. However, the mass flow meter 13 confirms whether or not the quantity of flow in terms of weight of the nitrogen gas 17 permits the vacuum generator 11 to sufficiently exhibit a vacuum generating capability. The vacuum generator 11 can exhibit the vacuum generating capability with the quantity of flow of the nitrogen gas of about 40 l/min or more. Thus, steps are added to confirm whether or not the quality of flow of the nitrogen gas flowing through the second flow path connecting pipe 13 is 40 l/min or more (steps C1, C7, and D3). When the quantity of flow of the nitrogen gas is less than 40 l/min, the air-operated valve 12 is closed (steps C2, C8, and D4).

A second different point is as described below. That is, the air-operated valve 5 is opened and the primary pipe 14 is evacuated, the pressure gauge 4 confirms whether or not it is reliably evacuated. Steps are added to confirm, when evacuation is stared, whether or not the pressure gauge 4 indicates a value of 0 MPa or less (steps C3, C9, and D5). The addition of these steps permits the evacuation to be executed reliably. When the value indicated by the pressure gauge 4 is not equal to or less than 0 MPa, the air-operated valves 5 and 12 are closed (steps C4, C10, and D6).

A third different point is as described below. That is, when the inert gas 15 such as nitrogen gas is introduced into the primary pipe 14 by opening the air-operated valve 3, the pressure gauge 4 confirms the pressure of the pressurized inert gas 15 such as nitrogen gas. When the pressure of the pressurized inert gas 15 such as nitrogen gas is less than 0.2 MPa, purge efficiency is reduced. Thus, steps are added to confirm that the pressure of the pressurized inert gas 15 is equal to or more than 0.2 MPa by the pressure gauge 4 (steps C5 and D1). When the pressure of the pressurized inert gas 15 such as nitrogen gas is less than 0.2 MPa, the air-operated valve 3 is closed (steps C6 and D2).

As apparent from the above description, the present invention accomplishes the following advantages.

1. Since the pipe can be purged with high-efficiency by executing the leaving-pipe-in-pressurized-state purge, the corrosion of the pipe in the cylinder cabinet can be prevented, and further the troubles of parts such as the air-operated valves and the pressure reducing valve can be reduced. A reason why the pipe can be purged with the high-efficiency is as described below. In general, the molecules in gas can be purged more promptly by vacuum purge. This is because lower pressure more increases the diffusing speed of the molecules, thereby the molecules can be diffused promptly and discharged. However, when the cylinder cabinet is used ordinarily, the molecules of gas are absorbed by the inside wall of the pipe because the gas is in contact with the pipe for a long time. The molecules of the gas having been absorbed by the inner wall of the pipe are not released unless physical energy is applied thereto. When the inside of the pipe is pressurized by nitrogen gas and left, nitrogen molecules collide against the molecules of the gas to be purged. As a result, the molecules of the gas absorbed by the inner wall of the pipe are discharged into a gas phase, thereby the inside of the pipe can be sufficiently purged.

2. Actually, the cylinder cannot be replaced just after the completion of leaving-pipe-in-pressurized-state purge. Thus, when the cylinder is left for a long time, the gas molecules absorbed by the inner wall of the pipe are released. The released gas molecules are discharged from the vacuum generator by executing the just-before-replacement purge, thereby the leakage of the gas caused when the cylinder is removed from the filling pipe when it is replaced can be prevented.

3. The amounts of inert gas used for purge and nitrogen gas used to start the vacuum generator can be reduced. This is because that the number of times of purge can be reduced due to the high-efficiency in purge and that the vacuum generator is stopped while the inside of the primary pipe is pressurized by the leaving-pipe-in-pressurized-state purge and the just-before-replacement purge.

What is claimed is:

1. A method of purging remaining gas in a pipe in a cylinder cabinet comprising a cylinder cabinet containing gas and having a valve, a filling pipe, a primary pipe, a first air-operated valve, a pressure reducing valve, a secondary pipe, and a second air-operated valve through which the cylinder is connected to a supply side, a third air-operated valve through which insert gas flows into the primary pipe, and a vacuum generator to which the primary pipe is connected through a fourth air-operated valve and a pipe, the method comprising the step of purging remaining gas in the primary pipe by automatically executing leaving-pipe-in pressurized-state purge for repeatedly pressurizing the inside of the primary pipe by the inert gas and leaving the pipe in the pressurized state for 2 to 10 minutes and evacuating the pipe for 20 seconds.

2. A method of purging remaining gas in a pipe according to claim 1, comprising the step of automatically repeating just-before-replacement purge for pressurizing the inside of the primary pipe by the inert gas for at least 10 seconds and evacuating the pipe for 20 seconds is automatically repeated ten times repeatedly just before the filling pipe is removed from the cylinder.

3. A method of purging remaining gas in a pipe according to claim 2, comprising the step of stopping the vacuum generator while the inside of the primary pipe is pressurized in the leaving-pipe-in-pressurized-state purge and the just-before-replacement purge.

4. A cylinder cabinet configuration, comprising:

a gas cylinder with a cylinder cut-off valve;

a primary line connected to the cut-off valve;

a primary line pressure gage connected to the primary line;

an inert gas line connected to the primary line via a first air operated valve;

a secondary line connected to the primary line via a second air operated line, the secondary line including a pressure reducing valve, a pressure gage, and a third air operated valve connected to a delivery outlet; and a purging configuration comprising a fourth air operated valve connected to the secondary line downstream of the pressure reducing valve and a fifth air operated valve connected to the primary line upstream of the second air operated valve, the fourth and fifth air operated valves commonly connected to a gas discharge line;

a sixth valve connecting the gas discharge line and a metered inert gas line to an exhaust gas line, the exhaust gas line being under vacuum.

* * * * *